US011525465B2

(12) United States Patent
Ingalhalikar et al.

(10) Patent No.: US 11,525,465 B2
(45) Date of Patent: Dec. 13, 2022

(54) MINIATURE PRESSURE COMPENSATING DEVICE

(71) Applicant: Indius Medical Technologies Private Limited, Maharashtra (IN)

(72) Inventors: Aditya Ingalhalikar, Maharashtra (IN); Sagar Sathaye, Maharashtra (IN); Manali Kunte, Maharashtra (IN); Gautam Samant, Pune (IN)

(73) Assignee: Indius Medical Technologies Private Limited, Maharashtra (IN)

( * ) Notice: Subject to any disclaimer, the term of this patent is extended or adjusted under 35 U.S.C. 154(b) by 22 days.

(21) Appl. No.: 17/278,448

(22) PCT Filed: Sep. 19, 2019

(86) PCT No.: PCT/IN2019/050687
§ 371 (c)(1),
(2) Date: Mar. 22, 2021

(87) PCT Pub. No.: WO2020/065662
PCT Pub. Date: Apr. 2, 2020

(65) Prior Publication Data

US 2021/0355968 A1 Nov. 18, 2021

(30) Foreign Application Priority Data

Sep. 24, 2018 (IN) ..... 201821035906

(51) Int. Cl.
*F15B 1/24* (2006.01)
*F15B 1/22* (2006.01)
(Continued)

(52) U.S. Cl.
CPC ..... *F15B 1/24* (2013.01); *F15B 1/04* (2013.01); *F15B 1/08* (2013.01); *F15B 1/22* (2013.01);
(Continued)

(58) Field of Classification Search
CPC .... F15B 1/24; F15B 2201/31; F15B 2201/40; F15B 2201/405; F15B 2201/4056; F15B 2201/60
(Continued)

(56) References Cited

U.S. PATENT DOCUMENTS 2,417,873 A * 3/1947 Huber ..... F15B 1/24 220/574.3
2,703,108 A * 3/1955 McCuistion ..... F15B 1/24 92/60
(Continued)

FOREIGN PATENT DOCUMENTS

DE 3920030 A * 12/1989 ..... B60K 6/12
FR 2845437 A1 * 4/2004 ..... F15B 1/08
(Continued)

*Primary Examiner* — Robert K Arundale
*Assistant Examiner* — Richard K. Durden
(74) *Attorney, Agent, or Firm* — Foley & Lardner LLP

(57) ABSTRACT

The present disclosure relates to a miniature pressure compensating device (10), for balancing pressure fluctuations in a hydraulic system, comprising at least one shell (12), at least one hollow hydraulic cylinder (16), at least one reciprocating piston (26) and at least one non-return valve (NRV) (28). The hydraulic cylinder (16) comprises at least one dual charging valve port (22) for facilitating charging of both said compressible and incompressible fluid and at least one built-in two-tier scaling mechanism (24) comprising at least one metal-to-metal seal (24*a*) and at least one secondary seal (24*b*) to achieve effective isolation of the incompressible and compressible fluids. The present miniature pressure compensating device (10) has a volume below 13 cc.

9 Claims, 4 Drawing Sheets

(51) Int. Cl.
*F15B 1/04* (2006.01)
*F15B 1/08* (2006.01)

(52) U.S. Cl.
CPC ..... *F15B 2201/205* (2013.01); *F15B 2201/31* (2013.01); *F15B 2201/40* (2013.01); *F15B 2201/4056* (2013.01); *F15B 2201/411* (2013.01); *F15B 2201/415* (2013.01); *F15B 2201/60* (2013.01)

(58) Field of Classification Search
USPC ..... 138/31
See application file for complete search history.

(56) References Cited

U.S. PATENT DOCUMENTS 3,136,340 A * 6/1964 Paul ..... F15B 1/24 138/31
3,474,830 A * 10/1969 Siegfried ..... F15B 1/24 138/30
4,403,629 A * 9/1983 de Vries ..... F15B 1/08 138/31
4,667,699 A * 5/1987 Loliger ..... F16L 55/052 99/452
5,771,936 A * 6/1998 Sasaki ..... F16L 55/053 138/30
7,665,484 B2 * 2/2010 Kamada ..... F02M 37/0041 138/30
9,435,356 B1 * 9/2016 Mallick ..... F15B 1/24
11,389,203 B2 * 7/2022 Ingalhalikar ..... A61B 17/7017
2010/0326063 A1 * 12/2010 LeBlanc ..... F15B 1/24 60/416
2015/0144216 A1 * 5/2015 Pippes ..... F15B 1/24 138/31
2017/0184133 A1 * 6/2017 Boucaux ..... F15B 1/106

FOREIGN PATENT DOCUMENTS

KR 20090039364 A 4/2009
WO WO-2014/175733 A1 10/2014

* cited by examiner

MINIATURE PRESSURE COMPENSATING DEVICE

CROSS-REFERENCES TO RELATED APPLICATIONS

The present application takes priority from Indian Provisional patent application number 201821035906 titled "Piston Type Hydraulic Accumulator for Medical Applications" dated Sep. 24, 2018.

BACKGROUND

The present disclosure relates to pressure compensating devices. Particularly, the present disclosure relates to pressure compensating devices used in hydraulic systems.

SUMMARY OF THE INVENTION

Pressure compensating devices or hydraulic accumulators when deployed for use in hydraulic systems, are known to work towards balancing pressure fluctuations. The current commercially available accumulators serve as energy storage devices for maintaining a temporary reserve of pressurized fluid to be supplied to the hydraulic system when fluid pressure within the hydraulic system drops.

Gas accumulator, a type of hydraulic accumulator known in the art, uses pre-charged gas in a trapped volume that maintains pressure against fluid separated in another chamber in the same accumulator. The fluid is forced out of the accumulator, into a hydraulic system line when the fluid pressure in that line drops; whereas the fluid re-enters the gas accumulator when the fluid pressure in the hydraulic system rises thereby balancing the fluid pressure in the entire system.

The role of gas as described hereinabove, can be carried out by various other mechanisms such as hydrostatic head of water, raised weights, compressed air or compressed gas with a metal or elastic diaphragm, springs and the like, which classifies the accumulators into different categories.

The different types of accumulators that are commercially available today, are however, known to have certain shortcomings associated therewith. Accumulators based on hydrostatic head and raised weights require a significantly huge space and are cost prohibitive. Accumulators based on spring are cost competitive as compared to the hydrostatic head-based accumulators, however, they require a larger footprint/volume to match the pressure levels of the hydraulic fluid when compared to compressed air/gas type of accumulators.

Accumulators based on compressed gas are best suited for use in hydraulic systems and are cost effective, however, have the requirement of a separate gas charging port (in addition to a fluid charging and discharging port), a separate diaphragm for facilitating gas-fluid separation and leak free joints at all these connections, making this type extremely bulky and heavy. In addition, the volume of fluid to be displaced is another major factor that has a huge impact on the size and weight of the accumulator.

A separate gas charging port, in addition to a fluid charging and discharging port, in addition to increasing the weight, increases the overall size and bulk of the accumulator. Attachment of a diaphragm or a metal bellow for separating the fluid and the gas requires additional space, further increasing the size. Even further, employing means to prevent leaking of pre-charged gas from the gas chamber, mandates installation of comprehensive sealing mechanisms that further increase the size, weight and cost of the accumulator, as leakage of the compressed gas affects the pre-charged pressure of the gas, which in turn affects the functioning of the accumulator and therefore, the hydraulic system connected thereto. Usage of multiple charging and discharging ports, separation media and the like provides additional potential leakage-prone points; leading to increased chances of malfunctioning of the accumulator, affecting the performance. Furthermore, due to the above-mentioned constraints, hydraulic accumulators that are currently available and commercially usable have a minimum size of only 13 cc; which renders them unsuitable for numerous other applications or hydraulic systems that need pressure compensating devices of lower volumes and overall size.

Therefore, there exists a need for compact hydraulic accumulators that address the afore-mentioned limitations. Further, there exists a need for compressed gas type accumulators that are simple and cost effective in construction. Even further, there is a need for compressed gas type accumulators having reduced size and weight whilst providing adequate strength. The inventors of the present disclosure provide a miniature compressed gas type pressure compensating device or accumulator that addresses the afore-mentioned drawbacks.

It is an object of the present disclosure to provide a miniature pressure compensating device.

It is an object of the present disclosure to provide a miniature pressure compensating device which is light in weight.

It is an object of the present disclosure to provide a miniature pressure compensating device which is economical.

It is an object of the present disclosure to provide a miniature pressure compensating device which is simple in construction and has less number of components.

It is an object of the present disclosure to provide a miniature pressure compensating device which has a built-in two-tier sealing mechanism, making the device more efficient.

It is an object of the present disclosure to provide a miniature pressure compensating device which has applicability across a very wide spectrum of industries.

The present disclosure provides a miniature pressure compensating device (10), for balancing pressure fluctuations in a hydraulic system, comprising at least one shell (12) containing at least one compressed and pressurized compressible fluid therein to form a compressible fluid chamber (14); at least one hollow hydraulic cylinder (16), threadedly disposed within and concentric with said shell (12), comprising a lower end in fluid communication with said compressible fluid chamber (14), forming an extension thereof, a middle portion adapted to contain at least one pressurized incompressible fluid to form an incompressible fluid chamber (18) and; a plurality of radial holes (20) for facilitating the movement of the pressurized compressible fluid therefrom into said shell (12) while charging; an upper end comprising at least one dual charging valve port (22) at a further upper end of said hydraulic cylinder (16) for facilitating charging of both said compressible and incompressible fluid by means of external charging systems and at least one built-in two-tier sealing mechanism (24) to achieve effective isolation of the incompressible and compressible fluids; said built-in two-tier sealing mechanism (24) comprising at least one metal-to-metal seal (24*a*) formed at the circumferential line contact of the hydraulic cylinder (16) and the shell (12) under torque to facilitate a primary grade of isolation and at least one secondary seal (24*b*) configured between the hydraulic cylinder (16) and the shell (12) to facilitate a secondary grade of isolation by preventing the leakage of the compressible fluid into the external environment in the event of failure of the metal-to-metal seal (24*b*); at least one reciprocating piston (26) disposed slidably and coaxially within said cylinder (16), adapted to facilitate said pressure compensating device (10) to gain equilibrium at a pre-determined target pressure value and function as a barrier between the incompressible (18) and compressible (14) fluid chambers; and at least one non-return valve (NRV) (28) installed in said dual charging valve port (22) of the hydraulic cylinder (16), adapted to hold said pressurized incompressible fluid in the said incompressible fluid chamber (18) after charging; and further adapted to regulate the flow of said pressurized incompressible fluid into the hydraulic system, upon actuation from an external mechanism, to address the pressure fluctuations within the hydraulic system and improving performance thereof. The pressure compensating device (10) is a hydraulic accumulator having a total fluid volume below 13 cc.

BRIEF DESCRIPTION OF THE DRAWINGS

The present disclosure is illustrated in the accompanying non-limiting drawings, throughout which like reference letters indicate corresponding parts in the various figures.

DETAILED DESCRIPTION

Figure 1:
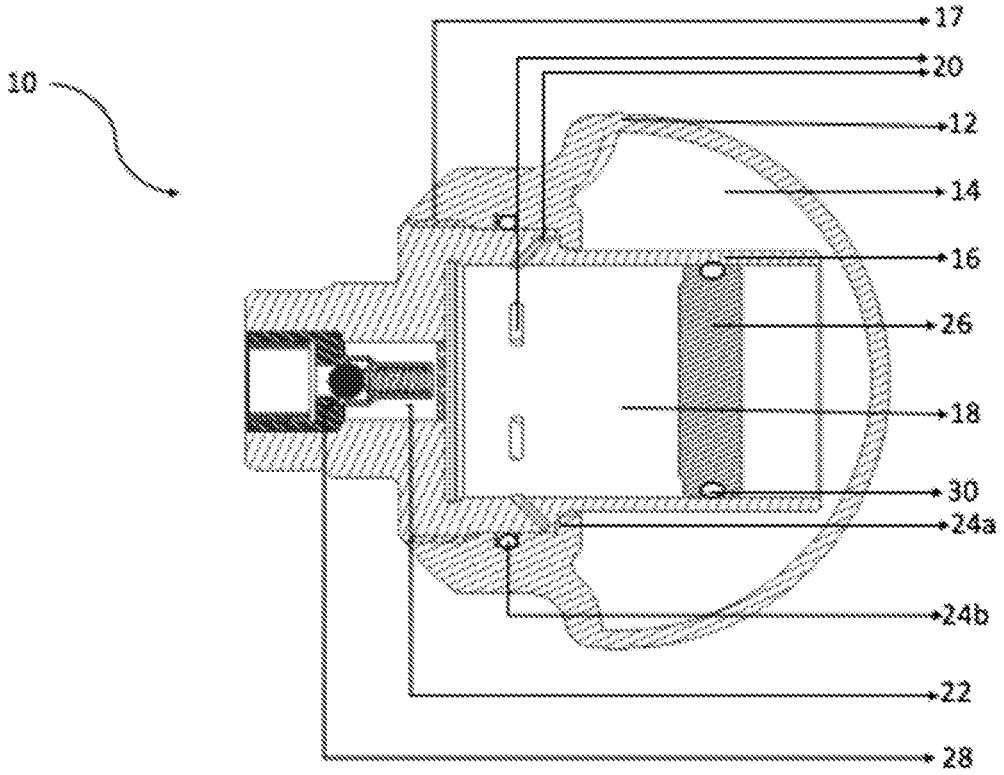
FIG. 1 illustrates a 2D cross section of the pressure compensating device (10) of the present disclosure.

The present disclosure provides a miniature pressure compensating device (10), for balancing pressure fluctuations in a hydraulic system. The term 'hydraulic system' used herein is meant to be understood in the general sense of the term and for the purpose of the present disclosure, includes any machine, hydraulic line, fluid line, actuator, hydraulic circuitry and like component/system/consumer requiring the pressurized fluid for balancing pressure fluctuations occurring therein.

The pressure compensating device (10) of the present disclosure, in one embodiment, is a hydraulic accumulator. The accumulator is adapted for being used in a hydraulic system/circuitry to improve efficiency, by balancing the pressure fluctuations generated therein. Particularly, the accumulator serves as an energy storage device for facilitating maintenance of a temporary reserve of pressurized fluid and transmits energy in the form of pressurized fluid to the hydraulic system when fluid pressure within the hydraulic system drops. For the purpose of the present disclosure, the gas is referred to as compressible fluid and the fluid/liquid is known as incompressible fluid.

The pressure compensating device (10) of the present disclosure has an external shape selected from group consisting of spherical, cylindrical, capsule-like or any other shape known in the art adapted to impart compactness thereto. The pressure compensating device (10) comprises at least one shell (12), at least one hydraulic cylinder (16) comprising at least one dual charging valve port (22) and at least one built-in two-tier sealing mechanism (24), at least one reciprocating piston (26) and at least one non-return valve (NRV) (28) as the crucial components. The components of the device (10), their construction, assembly and material of fabrication have been painstakingly arrived at after extensive permutations and combinations to create a pressure compensating device (10) having a total fluid volume below 13 cc. Particularly, pressure compensating device (10) of the present disclosure has a total fluid volume ranging from 0.1 cc to 13 cc. More particularly, pressure compensating device (10) of the present disclosure has a total fluid volume ranging from 0.1 cc to 10 cc.

Figure 2:
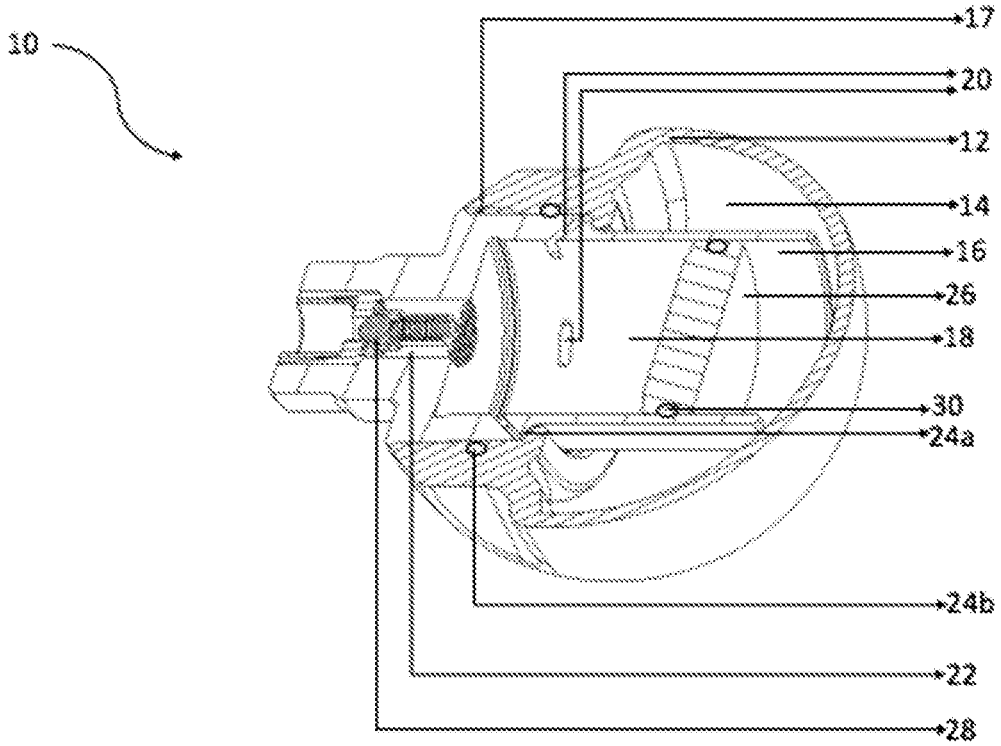
FIG. 2 illustrates a 3D cross section of the pressure compensating device (10) of the present disclosure.
Figure 3:
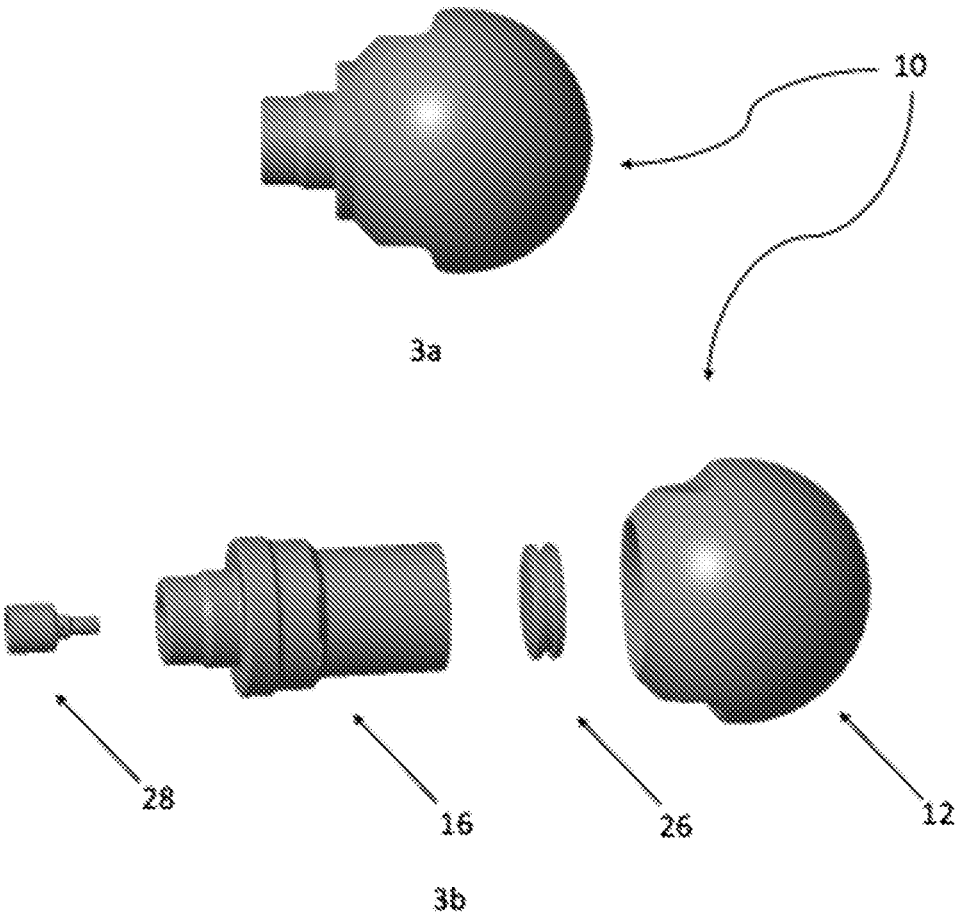
FIG. 3*a* illustrates a perspective view and FIG. 3*b* illustrates a blown-up perspective view of the pressure compensating device (10) of the present disclosure.

For ease of understanding, the area located near the bulge of the shell (12) is considered as the lower end and the area located away from the bulge of the shell (12) is considered as the upper end. The construction and arrangement of the components is illustrated in detail in FIGS. 1 and 2. The outer perspective and blown up perspective view of the device (10) is illustrated in FIGS. 3*a* and 3*b*.

The shell (12) of the present pressure compensating device (10) is hollow in construction and is adapted to house all the components of the pressure compensating device (10). The shell (12) is further adapted to contain at least one compressed and pressurized compressible fluid supplied thereto using external charging system(s), thereby forming a compressible fluid chamber (14) within the shell (12). In one embodiment, the compressible fluid is a gas. In accordance with the present disclosure, the compressible fluid is at least one selected from the group consisting of carbon dioxide gas, nitrogen gas, argon gas, helium gas, krypton gas, neon gas, xenon gas, radon gas and air. However, it is evident to those skilled in the art that the compressible fluid can be any other suitable fluid known in the art that works in such a hydraulic system. The shell (12) imparts adequate strength to the pressure compensating device (10) and is fabricated using at least one material selected from the group consisting of titanium, titanium alloy steel, steel, stainless steel, Cobalt-Chromium-Molybdenum, PEEK, metal and polymer. The shell (12) has a cross section of a shape selected from the group consisting of spherical, cylindrical, elliptical and polygonal. However, it is evident to those skilled in the art that the shape of the shell (12) and the material used for fabrication can be of any other variety suitable for use in such a hydraulic system.

The hollow hydraulic cylinder (16) of the present pressure compensating device (16) is disposed threadedly and in a substantially concentric fashion within the shell (12). The hydraulic cylinder (16) includes a threaded portion (17) configured along its external surface to facilitate threaded engagement and disengagement with an internally threaded portion of the shell (12). In one embodiment, the threaded portion (17), is at the upper end of the cylinder (16). The lower end of the cylinder (16) is in fluid communication with the compressible fluid chamber (14) and consequently forms an extension thereof. Along the middle part of the circumference of the cylinder (16), a plurality of radial holes (20) is machined, for facilitating the movement of the pressurized compressible fluid from the cylinder (16) into the shell (20) while charging. The middle portion is also adapted to contain at least one pressurized incompressible fluid supplied thereto using external charging system(s) (charging mechanism) and is reserved there-within; resulting in the formation of an incompressible fluid chamber (18). In one embodiment, the incompressible fluid is a liquid. In accordance with the present disclosure, the incompressible fluid is at least one selected from the group consisting of petroleum based fluids, saline water and water. However, it is evident to those skilled in the art that the incompressible fluid can be any other suitable fluid known in the art that works in such a hydraulic system. The cylinder (16) is fabricated using at least one material selected from the group consisting of titanium, titanium alloy steel, steel, stainless steel, Cobalt-Chromium-Molybdenum, PEEK, metal and polymer, however, it is evident to those skilled in the art that the cylinder (16) can be fabricated using any other strength imparting, light-weight material known in the art.

The pressurized incompressible fluid contained in the incompressible fluid chamber (18) is charged through at least one dual charging valve port (22) machined at the upper end of the hydraulic cylinder (16). The external charging system, via the dual charging valve port (22), supplies the cylinder with the incompressible fluid. It is a characteristic of the present pressure compensating device (10), that the dual charging valve port (10) is also adapted to charge the compressible fluid into the compressible fluid chamber (14). The presence of a single hardware for charging both the compressible and incompressible fluids in the device (10) is a characterizing feature of the present device (10). Elimination of separate charging ports in addition to reducing the bulk of the device (10) significantly, reduces the weight and building costs. The method of charging the compressible (14) and incompressible (18) fluid chambers via the dual charging valve port (22) is provided in detail in subsequent parts of the description.

Another characteristic of the present pressure compensating device (10) is the presence of at least one built-in two-tier sealing mechanism (24), to achieve effective isolation of the incompressible and compressible fluids, the latter being a major concern in compressed gas type accumulators. The built-in two-tier sealing mechanism (24) comprises at least one metal-to-metal seal (24*a*) and at least one secondary seal (24*b*) for achieving primary and secondary grades of isolation, respectively. The metal-to-metal seal (24*a*) is formed at the circumferential line contact of the hydraulic cylinder (16) and the shell (12) under torque, which causes effective separation of the incompressible (18) and compressible (14) fluid chamber. As this component is built-in, the weight and bulk of the device (10) remains unaffected. The secondary seal (24*b*) is configured between the hydraulic cylinder (16) and the shell (12) to prevent the leakage of the compressible fluid into the external environment in the event of failure of the metal-to-metal seal (24*a*). Particularly, the secondary seal (24*b*) ensures that the compressed fluid contained within the shell (12) when leaked through the metal-to-metal sealing (24*a*) gets released into the incompressible fluid chamber (18) instead of the external environment. This is particularly crucial for applications that do not permit release of compressible fluids into the environment such as the medicine or food industry. The secondary seal (24*b*) is at least one selected from the group consisting of O-ring(s), lip seal(s), quad seal(s) or any suitable seals. The two tier sealing mechanism (24), thus, increases the efficiency and performance of the pressure compensating device (10) and consequently that of the entire hydraulic system.

The reciprocating piston (26) of the present pressure compensating device (10) is disposed slidably and coaxially within the cylinder (10). The piston (26) is fabricated using at least one material selected from the group consisting of titanium, titanium alloy steel, steel, stainless steel, Cobalt-Chromium-Molybdenum, PEEK, metal and polymer, however, it is evident to those skilled in the art that the piston (26) can be fabricated using any other strength imparting, light-weight material known in the art. The piston (26) is capable of moving longitudinally within the hydraulic cylinder (10) and functions as a barrier ensuring separation of the incompressible (18) and compressible (14) fluid chambers. Furthermore, the lower end of the piston (26) extends within the compressible fluid chamber (14) and is acted upon by the compressive forces exerted by the compressed and pressurized compressible fluid contained within the shell (12), whereas upper end of the piston (26) remains disposed within the incompressible fluid chamber (18) and is acted upon by forces exerted by the pressurized incompressible fluid contained within the hydraulic cylinder (16). Pursuant to exertion of both the forces, the piston (26) positions itself at an equilibrium state where both the forces remain balanced. The piston (26) additionally includes at least one piston seal (30). The piston seal (30) offers a tight and leakage proof sealing to ensure that the communication between the compressible (14) and incompressible (18) fluid chamber is interrupted; thereby facilitating efficient separation of the two. The piston seal (30) is at least one selected from the group consisting of O-ring(s), lip seal(s), quad seal(s) or any suitable seals.

The non-return valve (NRV) (28) of the present pressure compensating device is installed in the dual charging valve port (22) of the hydraulic cylinder (16). In one non-limiting example embodiment, the NRV (28) is threadedly installed within the dual charging valve port (22). In a second non-limiting example embodiment, the NRV (28) is press-fitted within the dual charging valve port (22). In a third non-limiting example embodiment, the NRV (28) is installed in the dual charging valve port (22) using an expander sleeve. The NRV (28) is adapted to disallow the flow of the pressurized incompressible fluid in the incompressible fluid chamber (18) from the cylinder (16) to the external environment, after charging; thereby facilitating maintenance of the incompressible fluid under pressure within the hydraulic cylinder (16). Furthermore, upon actuation from an external mechanism such as a push pin or a mechanism to push open ball or poppet, the NRV (28) also allows the two-way movement of the pressurized incompressible fluid—from the cylinder (16) to the hydraulic system and vice versa, to address the pressure fluctuations within the hydraulic system. In one embodiment, the NRV (28) is also known as a check valve.

Before the pressure compensating device (10) is employed in a hydraulic system with the aim of balancing the pressure fluctuations, the device (10) is charged with compressible and incompressible fluids, to reach a target value. The target value is decided on the basis of the hydraulic system/application in which the device is to be employed, such that optimum balancing of pressure fluctuations may be possible.

Figure 4:
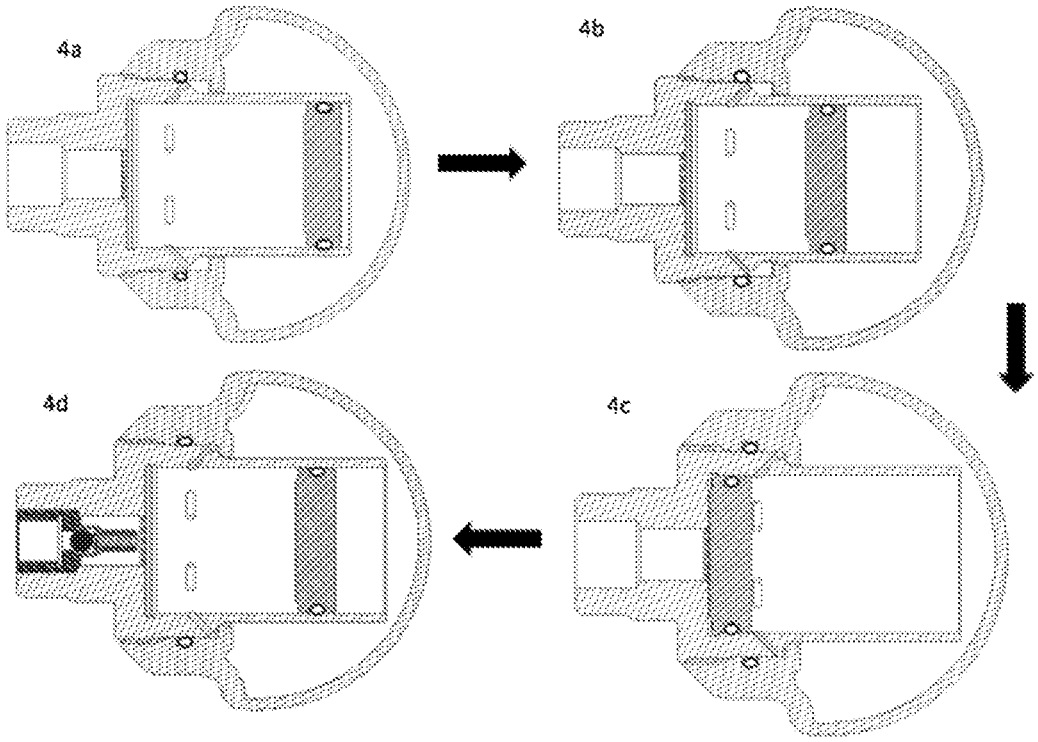
FIG. 4 illustrates the four stages reached by of the pressure compensating device (10) of the present disclosure, while charging with compressible and incompressible fluid.

Before beginning the charging, the pressure compensating device (10) is assembled in a specific manner and method/sequence. The secondary seal (24*b*) is first installed externally on the hydraulic cylinder (16). Subsequently, the piston seal (30) is fitted on the piston (26) and the piston (26) is placed within the hydraulic cylinder (16). The hydraulic cylinder (16) is then threadedly engaged within the shell (12) until a last thread is left unengaged such that the lower end of the piston (26) extends partially within the shell (12). At this point, pressurized compressible fluid is supplied through the dual charging valve port (22) using the external compressible fluid charging system. The pressurized compressible fluid via the dual charging valve port (22), enters the hydraulic cylinder (16) and fills up the enclosed space between the hydraulic cylinder (16) and the piston (26). As more and more pressurized compressible fluid starts entering this space, the piston (26) is pushed towards the lower end of the cylinder (16), to a point just before it touches the inner wall of the shell (12) (illustrated in FIG. 4*a*).

Further ingestion of the pressurized compressible fluid via the dual charging valve port (22) causes the compressible fluid to flow through the plurality of radial holes (20) configured along the middle part of the circumference of the cylinder (16), enter and fill up the hollow part of the shell (12). Once the shell (12) is almost filled up, the compressible fluid therein exerts pressure on the piston (26) (at the lower end of the cylinder (16)) to move away from the lower end. The piston (26) continues this movement until the pressurized and compressed compressible fluid contained within the shell (12) reaches a pre-determined target pressure value, at which point the piston (26) partially attains an equilibrium position (illustrated in FIG. 4*b*). In an embodiment, the target pressure value is determined and limited by the charging mechanism used to supply the pressurized compressible fluid to the pressure compensating device (10). Upon reaching the target pressure value, the hydraulic cylinder (16) is torqued in the shell (12) to the rated torque, which causes the metal-to-metal seal (24*a*) between the hydraulic cylinder (16) and the shell (12) to be fully engaged; thereby sealing the pressurized compressible fluid in a compressed state inside the shell (12) (not represented in the Figures). Thus, at this stage, the pressurized compressible fluid remains sealed and at the rated pressure with the assistance of the metal-to-metal sealing (24*a*) and the piston seal (30); thereby defining an independent compressible fluid chamber (14).

Thereafter, the external compressible fluid charging system is disengaged. Since the NRV (28) is not installed in the valve port (22) at this point, upon disengagement of the charging system, a part of the pressurized compressible fluid contained in the upper end of the cylinder (16) rushes towards the valve port (22), causing the piston (26) to move further away from the lower end of the cylinder (16) (illustrated in FIG. 4*c*).

At this point, the process of charging the incompressible fluid is initiated using an external incompressible fluid charging system. It is significant to note that the incompressible fluid is charged through the same dual charging valve port (22) that was used to charge the compressible fluid. The external incompressible fluid charging system is engaged with the dual charging valve port (22), now having the NRV (28) installed therein, for charging the pressurized incompressible fluid into the hydraulic cylinder (16). As more and more pressurized incompressible fluid flows into the hydraulic cylinder (16), the piston (26) is pushed towards the lower end of the cylinder (16). The movement of the piston (26) towards the lower end is continued until a point is reached where forces exerted on the piston (26) are balanced on both the sides. At this stage, equilibrium is attained and a pre-determined target pressure value is reached; thereby causing the upward movement of the piston (26) to cease (illustrated in FIG. 4*d*). In an embodiment, the target pressure value is determined and limited by the charging mechanism used to supply the pressurized incompressible fluid to the pressure compensating device (10). Thereafter, the external incompressible fluid charging system is disengaged from the valve port (22). Due to the presence of the NRV (28) in the port, the outward movement of the pressurized incompressible fluid is prevented; thereby causing the pressurized incompressible fluid to remain sealed and at the rated pressure within the hydraulic cylinder (16) and defining an independent incompressible fluid chamber (18) within the pressure compensating device (10). The thus charged device (10) becomes ready for deployment in any hydraulic system.

Typically, the pre-determined target pressure value ranges from 0.1 to 1000 Bar.

As a virtue of the presence of a common port (22) for charging and discharging of the pressurized incompressible as well as compressible fluid and a built-in two tier sealing mechanism (24), the size and weight of the present pressure compensating device (10) is scaled down significantly (below 13 cc). Further, as the afore-mentioned components are well contained in the overall functional envelope of the shell (12), optimization of size of the device (10) is easily attained. Even further, creation of additional leakage points is obviated which in turn enhances the safety. Still further, simple and robust construction of the device makes it cost-effective. Consequently, the efficiency and performance of the pressure compensating device (10) and consequently that of the entire hydraulic system is also achieved. Furthermore, since features such as the shape and material of fabrication are optimizable, the applicability of the device (10) increases manifold. The combination of all the aforementioned characteristics in the one device (10), makes the present pressure compensating device (10) highly sought after for use in diverse applications such as the medicine industry, the food industry and the like, along with other industries that typically employ hydraulic systems. Particularly, the present device (10) can be configured for use as an implantable or non-implantable device in orthopedics, cardiovascular systems, gastrointestinal systems, reproductive systems or any other medical use requiring force or pressure application specifically in compact spaces.

The embodiments described herein above are non-limiting. The foregoing descriptive matter is to be interpreted merely as an illustration of the concept of the present disclosure and it is in no way to be construed as a limitation. Description of terminologies, concepts and processes known to persons acquainted with technology has been avoided for the sake of brevity.

TECHNICAL ADVANTAGES AND ECONOMIC SIGNIFICANCE

The technical advantages and economic significance of the pressure compensating device (10) of the present disclosure are presented herein after:

- Total fluid volume below 13 cc
- Small size and weight
- Decreased leakage points
- Less components therefore more economical
- Built-in two tier sealing mechanism (24) makes the device safer
- A common/dual fluid charging mechanism (22) makes the device more compact

We claim:

1. A miniature pressure compensating device, for balancing pressure fluctuations in a hydraulic system, comprising:

a. at least one shell containing at least one compressed and pressurized compressible fluid therein to form a compressible fluid chamber;

b. at least one hollow hydraulic cylinder, threadedly disposed within and concentric with said at least one shell, comprising a lower end in fluid communication with said compressible fluid chamber, forming an extension thereof; a middle portion adapted to contain at least one pressurized incompressible fluid to form an incompressible fluid chamber and said middle portion comprising a plurality of radial holes for facilitating the movement of the pressurized compressible fluid therefrom into said at least one shell while charging; an upper end comprising at least one dual charging valve port for facilitating charging of both said compressible and incompressible fluids by external charging systems and at least one built-in two-tier sealing mechanism to achieve effective isolation of the incompressible and compressible fluids; said built-in two-tier sealing mechanism comprising at least one metal-to-metal seal formed at a circumferential line contact of the hydraulic cylinder and the at least one shell under torque to facilitate a primary grade of isolation and at least one secondary seal configured between the hydraulic cylinder and the at least one shell to facilitate a secondary grade of isolation by preventing leakage of the compressible fluid into an external environment in the event of failure of the metal-to-metal seal;

c. at least one reciprocating piston disposed slidably and coaxially within said hydraulic cylinder, adapted to facilitate said pressure compensating device to gain equilibrium at a pre-determined target pressure value and function as a barrier between the incompressible and compressible fluid chambers; and d. at least one non-return valve (NRV) installed in said dual charging valve port of the hydraulic cylinder, adapted to hold said pressurized incompressible fluid in the said incompressible fluid chamber after charging; and further adapted to regulate the flow of said pressurized incompressible fluid into the hydraulic system, upon actuation from an external mechanism, to address the pressure fluctuations within the hydraulic system.

2. The pressure compensating device as claimed in claim 1, having a total fluid volume below 13 cc.

3. The pressure compensating device as claimed in claim 1, having a total fluid volume ranging from 0.1 to 13 cc.

4. The pressure compensating device as claimed in claim 1, having a total fluid volume ranging from 0.1 to 10 cc.

5. The pressure compensating device as claimed in claim 1, wherein said compressible fluid is at least one selected from the group consisting of carbon dioxide gas, nitrogen gas, argon gas, helium gas, krypton gas, neon gas, xenon gas, radon gas and air.

6. The pressure compensating device as claimed in claim 1, wherein said incompressible fluid is at least one selected from the group consisting of petroleum based fluids, saline water and water.

7. The pressure compensating device as claimed in claim 1, wherein said pre-determined target pressure value ranges from 0.1 to 1000 Bar.

8. The pressure compensating device as claimed in claim 1, wherein said piston comprises at least one piston seal to prohibit fluid communication between the compressible and incompressible fluid chambers.

9. The pressure compensating device as claimed in claim 8, wherein said secondary seal and said piston seal are each at least one selected from the group consisting of O-ring(s), lip seal(s) and quad seal(s).

* * * * *